US005730641A

United States Patent [19]

Brown

[11] Patent Number: 5,730,641

[45] Date of Patent: Mar. 24, 1998

[54] BRASSIERE UNDERWIRE STAYS

[76] Inventor: Teresa M. Brown, 24 Nancy La., Piscataway, N.J. 08854

[21] Appl. No.: 745,322

[22] Filed: Oct. 9, 1996

[51] Int. Cl.[6] ..... A41C 3/10; A41C 3/14

[52] U.S. Cl. ..... 450/41; 450/49; 450/51; 450/52; 450/45; 2/255; 2/257

[58] Field of Search ..... 2/255, 256, 257, 2/258, 259, 260, 260.1, 261, 262, 263, 264, 1; 450/41, 42, 43, 44, 45, 46, 47, 48, 49, 50, 51, 52, 80, 143, 144

[56] References Cited

U.S. PATENT DOCUMENTS

| | | | |
|---|---|---|---|
| 345,767 | 7/1886 | Buckley | 450/143 |
| 531,684 | 1/1895 | Landenberger | 2/257 |
| 645,444 | 3/1900 | White et al. | 2/264 |
| 688,707 | 12/1901 | Sly | 450/143 |
| 968,142 | 8/1910 | Garlock | 2/255 |
| 1,207,104 | 12/1916 | Wallace | 2/259 |
| 2,469,722 | 5/1949 | Gowen | 2/257 |
| 2,912,983 | 11/1959 | Horn | 450/45 |
| 2,973,763 | 3/1961 | Rowell | 450/52 |
| 3,113,322 | 12/1963 | Bohm | 2/257 |
| 3,531,807 | 10/1970 | Deviot et al. | 2/256 |
| 3,562,802 | 2/1971 | Avis | 450/52 |
| 4,133,316 | 1/1979 | Scwartz | 450/52 |

*Primary Examiner*—Jeanette E. Chapman

[57] ABSTRACT

A first brassiere underwire stay (110) is integrally incorporated into a brassiere (16) which comprises a brassiere left cup (16L) and a brassiere right cup (16R). The first brassiere underwire stay (110) is composed of a first left U-shaped wire (112L) integrally incorporated into an underside of the brassiere left cup (16L). The first left U-shaped wire (112L) comprises a first left distal kidney shaped end piece (114LA) which is securely attached at a left distal end of the first left U-shaped wire (112L). A first left center kidney shaped end piece (114LC) is securely attached at a right distal end of the first left U-shaped wire (112L). A first right U-shaped wire (112R) is integrally incorporated into an underside of the brassiere right cup (16R). The first right U-shaped wire (112R) is composed of a first right distal kidney shaped end piece (114RA) securely attached at a right distal end of the first right U-shaped wire (112R). A first right center kidney shaped end piece (114RC) is securely attached at a left distal end of the first right U-shaped wire (112R), the first right center kidney shaped end piece (114RC). A second brassiere underwire stay (210) is integrally incorporated into a brassiere (16) which comprises a brassiere left cup (16L) and a brassiere right cup (16R). The second brassiere underwire stay (210) comprises a second left U-shaped wire (212L) integrally incorporated into an underside of the brassiere left cup (16L). The second left U-shaped wire (212L) comprises a second left distal kidney shaped end piece (214LA) securely attached at a left distal end of the second left U-shaped wire (212L). A second right U-shaped wire (212R) is integrally incorporated into an underside of the brassiere right cup (16R). The second right U-shaped wire (212R) comprises a second right distal kidney shaped end piece (214RA) securely attached at a right distal end of the second right U-shaped wire (212R). A second left center kidney a shaped end piece (214LC) is securely attached at a right distal end of the second left U-shaped wire (212L) and securely attached at a left distal end of the second right U-shaped wire (212R). A right brassiere underwire stay (110) which comprises a first left U-shaped wire (112L) having a first end and a second end. Attached to the first end is a flat kidney-shaped piece (114LA). Attached to the second end of the U-shaped wire (112L) is also a flat kidney shaped piece (114LC). The brassiere underwire stay (112L) are secured under the left breast cup (16L) of a brassiere (16). The flat kidney shaped end piece functions so as not to allow the underwire to poke through the weave of the brassiere fabric and thus preventing injury to the wearer and increasing the life of the garment.

4 Claims, 2 Drawing Sheets

BRASSIERE UNDERWIRE STAYS

BACKGROUND OF THE INVENTION

1. Field of the Invention

The present invention relates to an improved underwire brassiere support. More particularly, the present invention relates to an improvement in the underwire stays of a brassiere which are designed to increase comfort, increase the longevity of the brassiere and to protect the wearer from the underwire ends poking through the material.

2. Description of the Prior Art

Numerous innovations for underwire brassiere stays have been provided in the prior art that are described as follows. Even though these innovations may be suitable for the specific individual purposes to which they address, they differ from the present invention as hereinafter contrasted. Some of the prior inventions resemble the present invention to the extent that an underwire for a brassiere is formed in a U-shaped configuration. The prior art consists of brassiere wires of increased flexibility and wires with encapsulated tips. The prior art does not consider flattened kidney shaped ends for the underwire portion. This addition to the underwire increases the overall area of the ends and makes the ends blunt. This decreases the chance that the ends may pierce through the brassiere material injuring the wearer and damaging the garment.

In U.S. Pat. No. 4,770,650 (Ross Rowell) the invention consists of an improved brassiere wire. The improvement of this patent is annealing the wire so as to make it more flexible. This invention increases the flexibility of the wire and prevents damage to the fabric since the wire will bend with the fabric. The invention does not account for the narrowness of the ends which can easily penetrate the weave of the fabric. The present invention addresses this problem by making the ends flat and kidney shaped which decreases the chance that the ends will pierce the brassiere material. Since the kidney shaped pieces greatly exceed the width of the weave of the brassiere fabric, the ends cannot penetrate the weave. This limits damage to the garment and to the wearer.

In U.S. Pat. No. 4,275,750 (Jerome Weston)the invention described consists of a brassiere frame including a pair of arcuate wire members where a plastic hinge member interconnects the adjacent wire members. This invention provides that the wire members remain in a fixed location relative to one another. Although the central hinge will prevent the enclosed ends from piercing the fabric, the hinge is large and bulky and detracts from comfort. Additionally, the non-connected ends have no end piece. This can result in the fabric tearing as a result of the ends piercing the weave of the brassiere material. The current invention on the other hand has both ends of the wire enclosed which prevents piercing. The kidney shaped end caps are large and blunt enough to avoid the problem of having the wire cut the weave of the brassiere fabric. Additionally, comfort is preserved to the wearer since the kidney shaped pieces are flat and conform to the shape of the breast of the user.

The U.S. Pat. No. 5,219,311 (Gershad Fildan) for a brassiere wire or stay describes a brassiere wire which is adapted to fit into a breast cup of a brassiere. The wire has two grooves, which reduce the overall thickness of the wires at the ends to increase flexibility. These grooves decrease the thickness perpendicular to this plane and dimensioned so that the deflection of the zone out of the plane causes the bend of the wire in this region to have a circular arc segmented shape. The wire being constructed of plastic.

Although the wire is flexible and can bend to a certain extent with the moving fabric, the problem of the narrowness of the ends remains. The ends are still narrow enough to penetrate and cut the weave of the garment. This decreases the desirability of the brassiere to the user. It also leaves open the potential for the wearer to be bothered and made uncomfortable as the narrow edge of the wire sticks into her flesh.

U.S. Pat. No. 5,141,470 (Harvey S. Morgan et al.) for a monocoque breast supporting frame describes a sleeve which totally encases the underwire which is made of a co-polymeric material. The primary object of this invention is to provide a support for the frame that is of such a cross section as to result in pressure distribution along the wire frame. In contrast the current invention does not fully encase the wire. This is substantially different from having an increased kidney-sized end piece. The encasing of the Morgan patent does not address the problem of poking the wearer of the brassiere nor does it address the longevity of the garment. The end of the wire is not of an increased diameter. Since it is not thicker, the wire still has the potential for piercing the cloth of the brassiere and substantially damaging the garment resulting in a shortened life.

U.S. Pat. No. 4,201,220 (Ross F. Rowell) invention for brassiere wires relates a wire member which has a flexible end which is formed by providing a sheath about the ends where the end has a weakened point and is subsequently broken. The flexible end piece therefore encloses the broken wire end piece. This invention addresses the problem of piercing, but substantially differs from the current invention in terms of shape and comfort. The current invention is flat where the Rowell patent's tip is just variably thicker than the actual wire. The flatness of the current invention increases the comfort since it slips smoothly across the wearers body. The increased size of the current invention in the kidney shape decreases the possibility of ripping where the Rowell patent has a stiff end piece which is bendable at the point where it has been broken from the rest of the wire. Therefore, the Rowell invention still contains a narrow stiff end which can poke into the fabric.

SUMMARY OF THE INVENTION

The present invention differs from the above described prior art as the present invention includes a flat kidney shaped end piece which is substantially larger than the weave of the brassiere fabric. The kidney shaped end piece prevents the end of the wire from tearing the brassiere material and poking the wearer.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

In the manufacture of underwires there are numerous difficulties encountered in deciding how the ends of the stays will be completed so that they will not damage the material of the garment. The wire used in underwire bras can cause problems insofar as comfort is concerned since when the brassiere is repeatedly washed shrinkage can occur and the ends of the underwire can pierce through the fabric or sticking and become a source of discomfort.

The types of problems encountered in the prior art are the discomfort encountered with the underwire brassiere caused by the ends of the underwire piercing the fabric of the brassiere and irritating the wearer. A second problem encountered in the prior art concerns the underwire penetrating the weave of the brassiere material causing the brassiere to wear out at a quick rate. Another problem in the prior art has been that the two arcuate wire members operated independently of one another without interconnection other than by the materials interconnecting the brassiere pockets. Additionally the prior art has addressed the problem of piercing of the brassiere fabric by encapsulating a weakened end piece in a flexible material and breaking off the end of the wire so that it is supported solely in the flexible material.

In the prior art, unsuccessful attempts to solve the problem of the safety of the wearer were attempted namely: providing end caps or tips wherein the plastic material forming the cap ends extends beyond the end of the wire for a substantial distance. The end cap is flexible and renders the wire more resilient. This device is only moderately effective since the end of the wire still has a narrow surface area which can still cause piercing and can poke into the wearer of the brassiere. Additionally since the end caps extend far beyond the wire they are prone to breakage resulting in the same piercing problem. Proposals in the art have also suggested making a portion of the wire deflectably resilient by having two spaced-apart groves reducing the thickness of the wire making it more flexible. Again, the end surface area of the wire, whether made out of plastic or metal, is still not of a broad enough size to prevent the possibility of piercing. Similarly because of the decrease in thickness of the wire there is the potential that the flexible wire tip may break off causing the more rigid portion to pierce the brassiere material. Additionally the prior art has addressed the problem of piercing of the brassiere fabric by encapsulating a weakened end piece in a flexible material and breaking off the end of the wire so that it is supported solely in the flexible material. Again, the potential remains for piercing. The narrowness of the end piece along with the stiffness of the encapsulated broken-off wire provides the possibility that the wire can puncture the brassiere material.

The present invention solved a long felt need of increasing the life of the garment by decreasing the possibility of the underwire tearing the fabric of the garment since even small tears can increase in size upon multiple wearings and washings through the laundry. Once the garment has a tear subsequent movement of the material causes additional abrasion. The wire will cause additional damage to the garment each time the wearer or laundry place opposing forces on the garment and the wire, causing the wire to further penetrate and damage the fabric.

The present invention has an increased surface area while still remaining flat so that the comfort of the wearer is preserved. The flat kidney shaped pieces are large and blunt enough so as not to pierce the user. The current invention starts with an arcuate wire member which is formed into the shape of a U to conform to the cup of a brassiere. Attached to the ends by means of welding are two separate flat kidney shaped end caps. The thickness of these end pieces is substantially equivalent to the thickness of the wire. The increased mass at the end when placed inside the fabric of the bra prevents the wire from protruding through the material. Because there are no sharp edges or narrow tubular end sections the weave of the brassiere fabric cannot be pierced, even as the wire shifts. The present invention also aids the wearer by preventing the ends from poking into the wearer. The flat kidney shape precludes the narrow wire from digging into the user.

The kidney shaped members can be constructed out of various materials, both flexible and solid. The main consideration with regard to shaping is that the piece must be contoured to the shape of a woman's breast. A further consideration is that the piece must be essentially flat with a minimum of thickness not to be greatly in excess of the size of the wire. The brassiere underwire stay may be constructed from a material selected from a group consisting of metal, metal alloy, plastic, plastic composite, fiberglass, epoxy, carbon-graphite, and wood.

A second possible embodiment is denoted by two U-shaped wires attached at a center location by bonding the ends of the two wires to a central flat kidney shaped piece. The two outer ends of the wires which are not attached together have kidney shaped pieces attached thereto. This embodiment provides all of the advantages of the first embodiment in a singular unit. Since the embodiment is of a unitary construction, it has the further advantage of limited slippage within the fabric of the brassiere.

Novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWINGS

Common Components of Embodiments

16-brassiere (16)

16L-brassiere left cup (16L)

16R-brassiere right cup (16R)

First Embodiment

110-first brassiere underwire stay (110)

112L-first left U-shaped wire (112L)

112R-first right U-shaped wire (112R)

114LA-first left distal kidney shaped end piece (114LA)

114LC-first left center kidney shaped end piece (114LC)

114RA-first right distal kidney shaped end piece (114LA)

114RC-first right center kidney shaped end piece (114LC)

Second Embodiment

210-second brassiere underwire stay (210)

212L-second left U-shaped wire (212L)

212R-second right U-shaped wire (212R)

214LA-second left distal kidney shaped end piece (214LA)

214C-second left center kidney shaped end piece (214C)

214RA-second right distal kidney shaped end piece (214LA)

DETAILED DESCRIPTION OF THE PREFERRED EMBODIMENT

Figure 1:
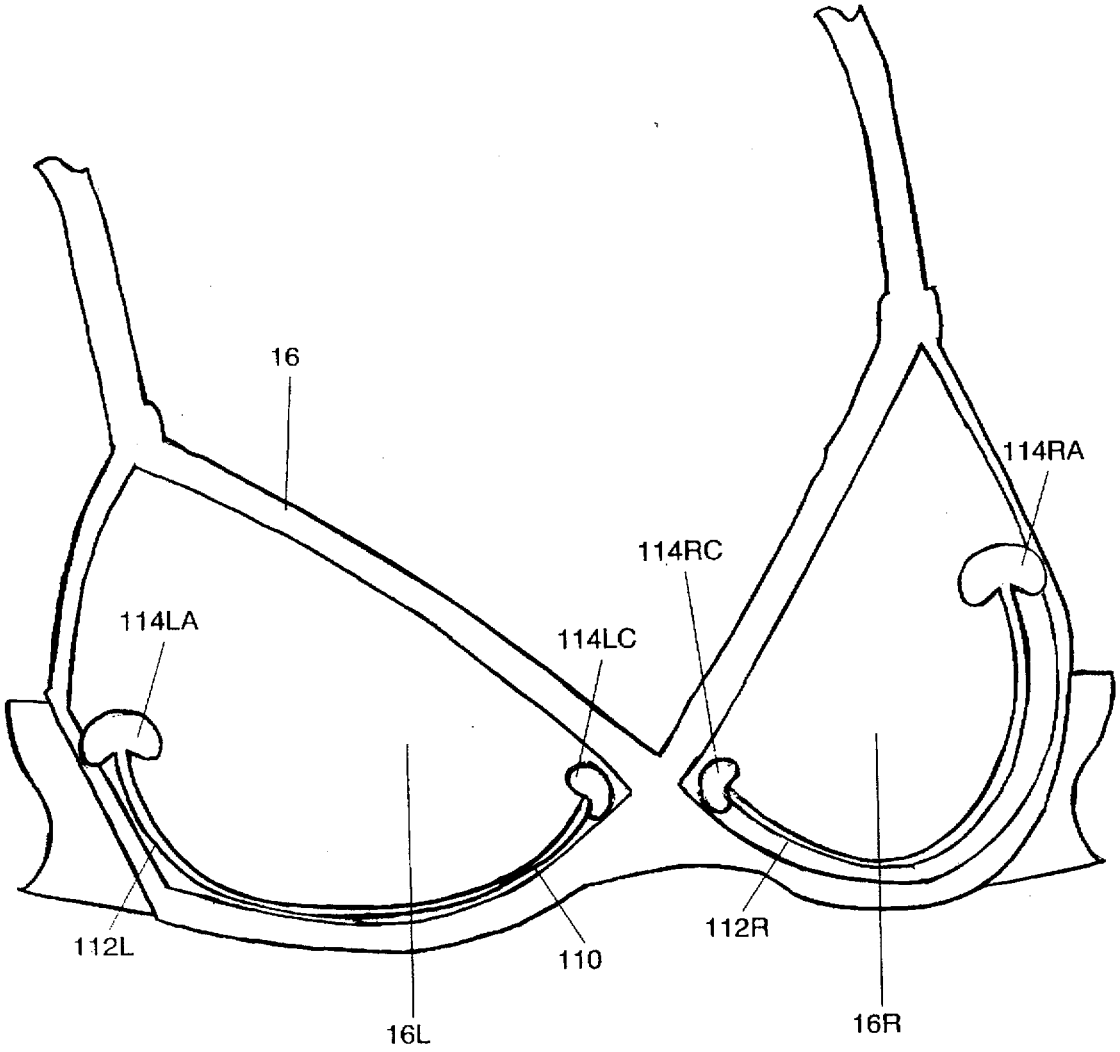
FIG. 1 is a perspective view of a first brassiere underwire stay.

Referring now to FIG. 1, the first brassiere underwire stay (110) which is integrally incorporated into a brassiere (16)

and includes a U-shaped wire (112L) containing a first end and a second end. The U-shaped wire (112L) is inserted inside the left brassiere cup (16L) and is secured to the brassiere (16) by enclosing the wire within the perimeter of the brassiere cup (16L). Connected to the first end of the U-shaped wire (112L) is a first left distal kidney shaped end piece (114LA). A first left center kidney shaped end piece (114LC) The first left end piece (114LA) comprises an elliptical configuration having a convex surface with an opposite concave surface. The left distal end of the first left U-shaped wire (112L) is securely attached to the concave surface. is securely attached at the second end of the first left U-shaped wire (112L).

The first left center piece (114LC) comprises an elliptical configuration having an convex surface with an opposite concave surface. The right distal end of the first left U-shaped wire (112L) is securely attached to the convex surface. The first left center piece (114LC) functions to prevent the right distal end of the first left U-shaped wire (112L) from irritating the user's body.

The first right end piece (114RA) comprises an elliptical configuration having a convex surface with an opposite concave surface. The right distal end of the first left U-shaped wire (112R) is securely attached to the concave surface. The first right end piece (114RA) functions to prevent the right distal end of the first left U-shaped wire (112R) from irritating the user's body.

A first right U-shaped wire (112R) is positioned under the right brassiere cup (16R). A first right distal kidney shaped end piece (114RA) is attached at a right distal end of the first right U-shaped wire (112R). A first right center kidney shaped end piece (114RC) is attached at a left distal end of the first right U-shaped wire (112R). The first right center piece (114RC) comprises an elliptical configuration having an convex surface with an opposite concave surface. The left distal end of the first right U-shaped wire (112R) is securely attached to the convex surface.

The distal kidney shaped end piece (114LA, 114RA) and the first right center kidney shaped end piece (114LC, 114RC) function to protect the user from the distal ends of the U-shaped wire (112L, 112R) if they protrude through the brassiere (16).

Figure 2:
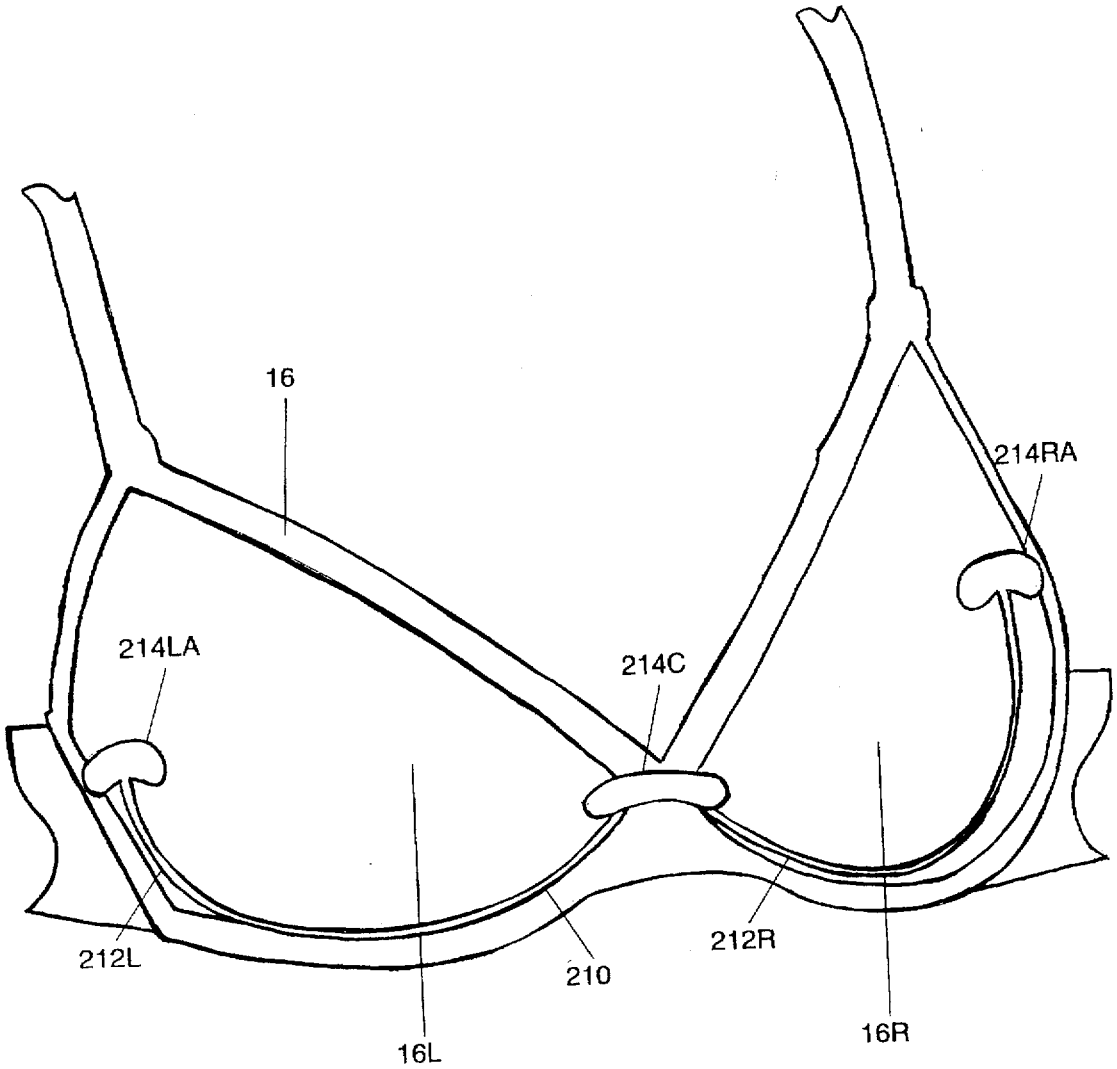
FIG. 2 is a perspective view of a second brassiere underwire stay.

Referring to FIG. 2 which is a perspective view of a second brassiere underwire stay (210) which comprises a second left U-shaped wire (212L) having a second left distal kidney shaped end piece (214LA) positioned at a left distal end and a second right U-shaped wire (212R) having a second right distal kidney shaped end piece (214RA) positioned at a right distal end.

The second left end piece (214LA) comprises an elliptical configuration having a convex surface with an opposite concave surface. The left distal end of the second left U-shaped wire (212L) is securely attached to the concave surface.

The second right end piece (214RA) comprises an elliptical configuration having a convex surface with an opposite concave surface. The right distal end of the second right U-shaped wire (212R) is securely attached to the concave surface. The second left U-shaped wire (212L) and the second right U-shaped wire (212R) are attached to one another by a second center kidney shaped end piece (214C). The second center end piece (214C) comprises an elliptical configuration having a convex surface with an opposite concave surface. The distal end of the second right U-shaped wire (212R) and the right distal end of the second left U-shaped wire (212L) are securely attached to the concave surface. The second left U-shaped wire (212L) is inserted inside the left brassiere cup (16L) and is secured to the brassiere (16) by enclosing the wire within the perimeter of the brassiere cup (116L). The second right U-shaped wire (212R) is inserted inside the right brassiere cup (16R) and is secured to the brassiere (16) by enclosing the wire within the perimeter of the right brassiere cup (16R).

The second left distal kidney shaped end piece (214LA), second right distal kidney shaped end piece (214RA), and second center kidney shaped end piece (214C) function to protect the user from the distal ends of the U-shaped wire (112L, 112R) if they protrude through the brassiere (16).

While the invention has been illustrated and described as embodied in a brassiere underwire stay, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A first brassiere underwire stay (110) integrally incorporated into a brassiere (16) which comprises a brassiere left cup (16L) and a brassiere right cup (16R), the first brassiere underwire stay (110) comprises:

A) a first left U-shaped wire (112L) integrally incorporated into an underside of the brassiere left cup (16L), the first left U-shaped wire (112L) comprises:

I) a first left end piece (114LA) securely attached at a left distal end of the first left U-shaped wire (112L), the first left end piece (114LA) comprises a configuration having a convex surface with an opposite concave surface, the left distal end of the first left U-shaped wire (112L) is securely attached to the concave surface, the first left end piece (114LA) functions to prevent the left distal end of the first left U-shaped wire (112L) from irritating a user's body, and ii) a first left center piece (114LC) securely attached at a right distal end of the first left U-shaped wire (112L), first left center piece (114LC) comprises a configuration having an convex surface with an opposite convex surface, the right distal end of the first left U-shaped wire (112L) is securely attached to the opposite convex surface, the first left center piece (114LC) functions to prevent the right distal end of the first left U-shaped wire (112L) from irritating the user's body; and B) a first right U-shaped wire (112R) integrally incorporated into an underside of the brassiere right cup (16R), the first right U-shaped wire (112R) comprises:

I) a first right end piece (114RA) securely attached at a right distal end of the first right U-shaped wire (112R), the first right end piece (114RA) comprises a configuration having a convex surface with an opposite concave surface, the right distal end of the first left U-shaped wire (112R) is securely attached to the concave surface, the first right end piece (114RA)

functions to prevent the right distal end of the first left U-shaped wire (112R) from irritating the user's body, and ii) a first right center piece (114RC) securely attached at a left distal end of the first right U-shaped wire (112R), the first right center piece (114RC) comprises a configuration having an convex surface with an opposite convex surface, the left distal end of the first right U-shaped wire (112R) is securely attached to the opposite convex surface, the first right center piece (114RC) functions to prevent the left distal end of the first right U-shaped wire (112R) from irritating the user's body.

2. The first brassiere underwire stay (110) as described in claim 1 is constructed from a material selected from a group consisting of metal, metal alloy, plastic, plastic composite, fiberglass, epoxy, carbon-graphite, and wood.

3. A second brassiere underwire stay (210) integrally incorporated into a brassiere (16) which comprises a brassiere left cup (16L) and a brassiere right cup (16R), the second brassiere underwire stay (210) comprises:

A) a second left U-shaped wire (212L) integrally incorporated into an underside of the brassiere left cup (16L), the second left U-shaped wire (212L) comprises:

I) a second left end piece (214LA) securely attached at a left distal end of the second left U-shaped wire (212L), the second left end piece (214LA) comprises a configuration having a convex surface with an opposite concave surface, the left distal end of the second left U-shaped wire (212L) is securely attached to the concave surface, the second left piece (214LA) functions to prevent the second left U-shaped wire (212L) from irritating a user's body, and B) a second right U-shaped wire (212R) integrally incorporated into an underside of the brassiere right cup (16R), the second right U-shaped wire (212R) comprises:

I) a second right end piece (214RA) securely attached at a right distal end of the second right U-shaped wire (212R), the second right end piece (214RA) comprises a configuration having a convex surface with an opposite convex surfaces, the right distal end of the second right U-shaped wire (212R) is securely attached to the convex surface, the second right distal kidney shaped end piece (214RA) functions to prevent the right distal end of the second right U-shaped wire (212R) from irritating the user's body, and ii) a second center end piece (214C) securely attached at a right distal end of the second left U-shaped wire (212L) and securely attached at a left distal end of the second right U-shaped wire (212R), the second center end piece (214C) comprises an configuration having a convex surface with an opposite convex surfaces, the left distal end of the second right U-shaped wire (212R) and the right distal end of the second left U-shaped wire (212L) are securely attached to the convex surfaces, the second center kidney shaped end piece (214C) functions to prevent the distal ends of the U-shaped wire (212L, 212R) from irritating the user's body.

4. The first brassiere underwire stay (110) as described in claim 3 is constructed from a material selected from a group consisting of metal, metal alloy, plastic, plastic composite, fiberglass, epoxy, carbon-graphite, and wood.

* * * * *